US007657193B2

(12) United States Patent
Wada

(10) Patent No.: US 7,657,193 B2
(45) Date of Patent: Feb. 2, 2010

(54) CONSUMABLE MANAGEMENT DEVICE, IMAGE FORMING APPARATUS, COMPUTER READABLE MEDIUM STORING A PROGRAM, AND CONSUMABLE MANAGEMENT METHOD

(75) Inventor: Yoshinori Wada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 202 days.

(21) Appl. No.: 11/826,464

(22) Filed: Jul. 16, 2007

(65) Prior Publication Data

US 2008/0124096 A1 May 29, 2008

(30) Foreign Application Priority Data

Nov. 28, 2006 (JP) ..... 2006-319472

(51) Int. Cl.
*G03G 15/00* (2006.01)
*G03G 15/08* (2006.01)

(52) U.S. Cl. ..... 399/26; 399/24; 399/25; 399/27; 399/28

(58) Field of Classification Search ..... 399/12, 399/24–28

See application file for complete search history.

(56) References Cited

U.S. PATENT DOCUMENTS 5,305,199 A 4/1994 Lobiondo et al.
5,572,292 A 11/1996 Chatani et al.
5,850,583 A * 12/1998 Song et al. ..... 399/24
6,275,664 B1 8/2001 Wolf et al.
6,493,517 B1 12/2002 Hanson
7,031,623 B2 * 4/2006 Haramoto ..... 399/12
2008/0089719 A1 * 4/2008 Zehentbauer et al. ..... 399/259

FOREIGN PATENT DOCUMENTS

EP 0 685 768 A1 12/1995
JP A-05-270114 10/1993
JP A-2001-228761 8/2001
JP A-2003-330695 11/2003

* cited by examiner

*Primary Examiner*—David M Gray
*Assistant Examiner*—G. M. Hyder
(74) *Attorney, Agent, or Firm*—Oliff & Berridge PLC

(57) ABSTRACT

A consumable management device includes a life determining unit that determines whether a consumable reaching a life end exists in an object apparatus which operates with a plurality of consumables or not, a stop process unit that, when the life determining unit determines that a consumable reaching a life end exists, performs a stop process of stopping the operation of the object apparatus, an additional replacement determining unit that, when the object apparatus is to be stopped, determines whether, in addition to replacement or replenishment of the consumable, a consumable which is to be replaced or replenished exists or not, and a notification process unit that, when the additional replacement determining unit determines that a consumable which is to be additionally replaced or replenished exists, performs a notification process of notifying an operator that the consumable which is to be additionally replaced or replenished is to be replaced or replenished.

9 Claims, 8 Drawing Sheets

FIG. 5A

SCREEN A

ERROR: TONER EMPTY K

PERFORM WORK OF REPLACING CONSUMABLE

24

START

FIG. 5B

SCREEN B

REPLENISHMENT OF TONER K

1. REMOVE EMPTY TONER BOTTLE.
2. SHAKE NEW TONER BOTTLE SEVERAL TIMES, AND SET THE BOTTLE INTO TONER HOPPER.
3. WHEN THE WORKS ARE ENDED, PRESS END BUTTON.

25

END

FIG. 6A

SCREEN C

REPLACEMENT OF FOLLOWING CONSUMABLES IS RECOMMENDED.

PERFORM WORK OF REPLACING CONSUMABLE

TONER FILTER Y: 4% REMAINS

TONER FILTER M: 4% REMAINS

DEVELOPER K: 2% REMAINS

26

START

FIG. 6B

SCREEN D

REPLACEMENT OF FOLLOWING CONSUMABLES IS RECOMMENDED.

PERFORM WORK OF REPLACING CONSUMABLE

TONER FILTER Y: 4% REMAINS

TONER FILTER M: 4% REMAINS

27

CLOSE

26

START

FIG. 7A

THRESHOLD SETTING SCREEN 1

SETTING OF THRESHOLD OF CONSUMABLE

SELECT

28

TONER

TONER FILTER

DEVELOPER

DRUM CLEANER BRUSH

TRANSFER CLEANER

DESMOKE FILTER

FIG. 7B

THRESHOLD SETTING SCREEN 2

SETTING OF THRESHOLD OF DEVELOPER

CONFIRM

29

● THRESHOLD (TH1)

● SINGLE PRINTING OPERATION: 5%

○ TANDEM PRINTING OPERATION: 6%

○ THRESHOLD (TH2)

○ SINGLE PRINTING OPERATION: 2%

○ TANDEM PRINTING OPERATION: 3%

CONSUMABLE MANAGEMENT DEVICE, IMAGE FORMING APPARATUS, COMPUTER READABLE MEDIUM STORING A PROGRAM, AND CONSUMABLE MANAGEMENT METHOD

CROSS-REFERENCE TO RELATED APPLICATIONS

This application is based on and claims priority under 35 USC 119 from Japanese Patent Application No. 2006-319472 filed on Nov. 28, 2006.

BACKGROUND

1. Technical Field

The present invention relates to a consumable management device, an image forming apparatus, and a computer readable medium storing a program.

2. Related Art

An image forming apparatus such as a printer, a copier, or a facsimile apparatus performs an image forming operation by using consumables typified by an ink, a toner, and the like. In an apparatus of this kind, therefore, the remaining amount of the consumable is periodically detected, a timing of replacement of each consumable is estimated based on a result of the detection, and, when the replacement timing approaches, a warning indicative of this is displayed on an operation screen for the operator, thereby prompting replacement of the consumable.

SUMMARY

According to an aspect of the invention, there is provided a consumable management device including: a life determining unit that determines whether a consumable reaching a life end exists in an object apparatus which operates by using a plurality of consumables or not; a stop process unit that, when the life determining unit determines that a consumable reaching a life end exists, performs a stop process of stopping the operation of the object apparatus; an additional replacement determining unit that, when the object apparatus is to be stopped, determines whether, in addition to replacement or replenishment of the consumable, a consumable which is to be replaced or replenished exists or not; and a notification process unit that, when the additional replacement determining unit determines that a consumable which is to be additionally replaced or replenished exists, performs a notification process of notifying an operator that the consumable which is to be additionally replaced or replenished is to be replaced or replenished.

BRIEF DESCRIPTION 0F THE DRAWINGS

Exemplary embodiments of the present invention will be described in detail based on the following figures, wherein:

FIGS. 5A and 5B are views (No. 1) showing an example of a screen which is displayed in a notification process;

FIGS. 6A and 6B are views (No. 2) showing an example of the screen which is displayed in the notification process;

Figure 8:
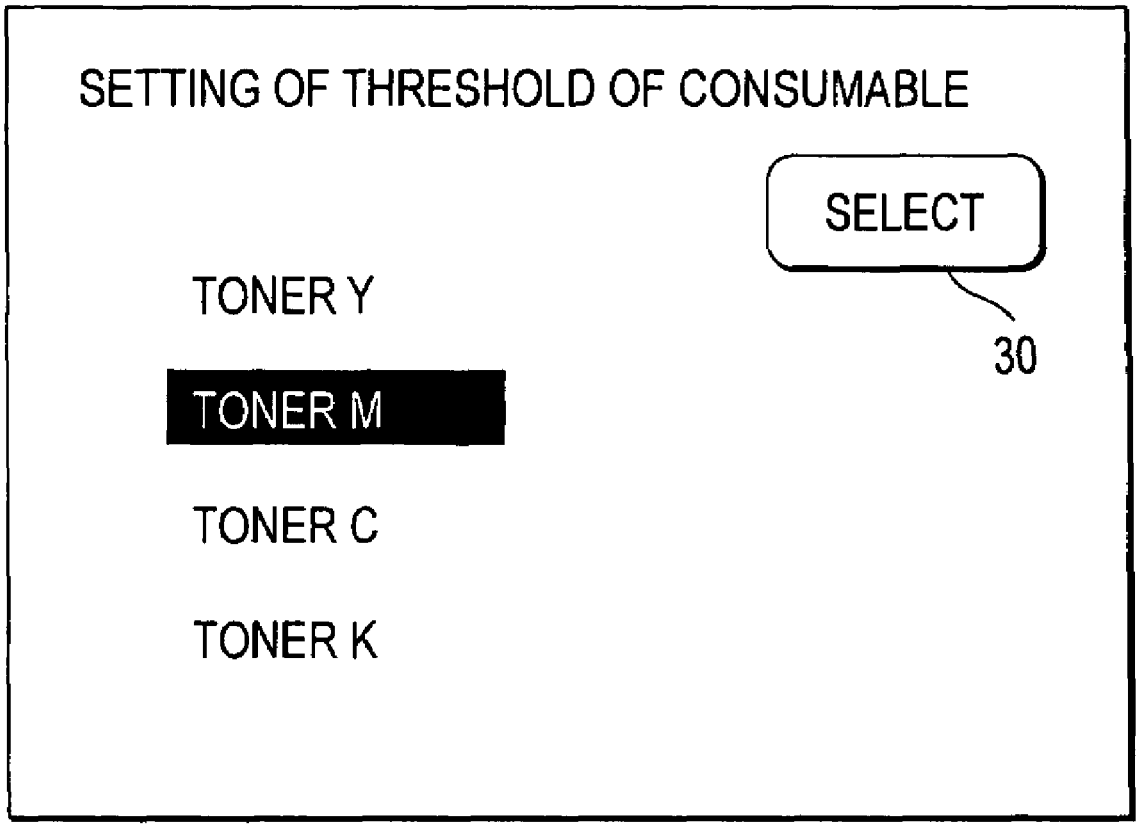

FIGS. 7A and 7B are views showing an example of a threshold setting screen; and FIG. 8 is a view showing another example of the threshold setting screen, wherein 1 denotes sheet feeding apparatus, 2 denotes front-surface printing apparatus, 3 denotes sheet reversing apparatus, 4 denotes rear-surface printing apparatus, 5 denotes buffer apparatus, 6 denotes post-processing apparatus, 11 denotes control unit, 12 denotes operation panel, 13 denotes printing mechanism unit, 14 denotes CPU, 15 denotes ROM, 16 denotes RAM, 17 denotes non-volatile memory, 20 denotes hard disk drive, 22 denotes printing mechanism driving portion, 23 denotes remaining amount detecting portion, and 100 denotes printing apparatus

DETAILED DESCRIPTION

Hereinafter, an exemplary embodiment in which the invention is applied to a tandem printing apparatus will be described in detail with reference to the accompanying drawings. A tandem printing apparatus is configured by connecting (coupling) plural printing apparatuses with one another. The invention is not restricted to a tandem printing apparatus, and can be applied to a wide variety of known printing apparatuses. The exemplary embodiment of the invention will be described by illustrating a printing apparatus of the electrophotographic type as an example. However, the invention is not restricted to this, and can be applied also to printing apparatuses of other printing systems such as the offset printing system and the inkjet printing system.

Furthermore, the invention is not restricted to a printing apparatus, and can be widely applied also to any apparatus as far as it operates by using plural consumables, for example, an image forming apparatus (including a printing apparatus) such as a copier, or a facsimile apparatus, or an electronic apparatus other than an image forming apparatus. The invention can be realized also as: a consumable management device which uses an electronic apparatus including an image forming apparatus as an object apparatus; or a computer program for consumable management.

Figure 1:
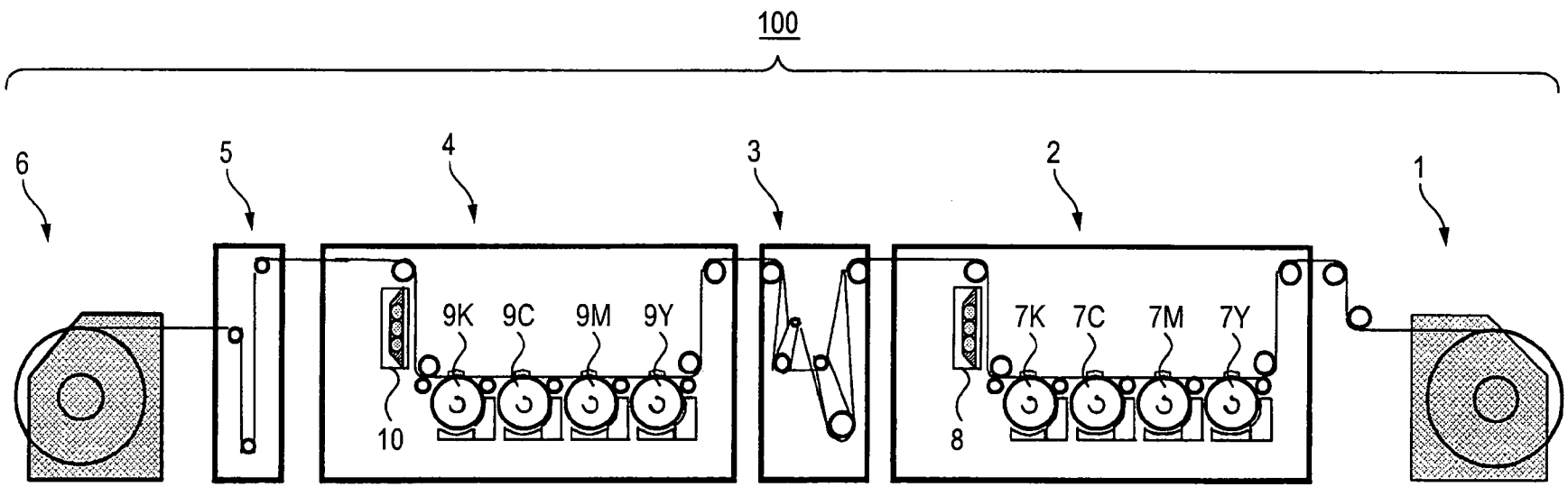
FIG. 1 is a diagram showing a configuration example of a printing apparatus to which the invention is applied.

FIG. 1 is a diagram showing a configuration example of a printing apparatus to which the invention is applied. The illustrated printing apparatus 100 roughly includes a sheet feeding apparatus 1, a front-surface printing apparatus 2, a sheet reversing apparatus 3, a rear-surface printing apparatus 4, a buffer apparatus 5, and a post-processing apparatus 6.

The sheet feeding apparatus 1 feeds a continuous sheet wound in a roll, by rotation of the roll. The front-surface printing apparatus 2 prints an image onto the front surface of the continuous sheet fed from the sheet feeding apparatus 1. The sheet reversing apparatus 3 discharges the continuous sheet discharged from the front-surface printing apparatus 2, while reversing the front and rear surfaces of the continuous sheet.

The rear-surface printing apparatus 4 prints an image onto the rear surface of the continuous sheet discharged from the sheet reversing apparatus 3. The buffer apparatus 5 conveys the continuous sheet while applying an adequate tension to the continuous sheet so that an excessive tension or slack is not produced in the continuous sheet by the difference between the process speeds of the rear-surface printing apparatus 4 and the post-processing apparatus 6. The post-processing apparatus 6 wounds the printed continuous sheet which is conveyed via the buffer apparatus 5, into a roll. The post-processing apparatus 6 may have functions of cutting the printed continuous sheet into a predetermined length, folding the continuous sheet, stapling plural cut sheets while stacking them, and punching the sheets.

The front-surface printing apparatus 2 prints a color image onto the continuous sheet with using toners of four colors of, for example, yellow (Y), magenta (M), cyan (C), and black (K). The front-surface printing apparatus 2 includes a quadruple tandem printing engine having four photosensitive drums 7Y, 7M, 7C, 7K respectively corresponding to the colors of Y, M, C, K. A charging device, a laser exposing device, a developing device, a transferring device, a drum cleaner, and the like are arranged around each of the photosensitive drums 7Y, 7M, 7C, 7K. A fixing device 8 which fixes toner images transferred onto the continuous sheet from the four photosensitive drums 7Y, 7M, 7C, 7K is incorporated in the front-surface printing apparatus 2. Similarly, the rear-surface printing apparatus 4 includes four photosensitive drums 9Y, 9M, 9C, 9K, and a fixing device 10.

In the thus configured printing apparatus 100, the continuous sheet fed from the sheet feeding apparatus 1 is introduced into the front-surface printing apparatus 2, toner images are transferred onto the continuous sheet from the photosensitive drums 7Y, 7M, 7C, 7K in the front-surface printing apparatus 2, and then the toner images are fixed to the continuous sheet by the fixing device 8, whereby a color image is formed on the front surface of the continuous sheet.

Then, the continuous sheet fed out from the front-surface printing apparatus 2 is reversed by the sheet reversing apparatus 3, and thereafter the reversed sheet is fed into the rear-surface printing apparatus 4. In the rear-surface printing apparatus 4, toner images are transferred onto the continuous sheet from the photosensitive drums 9Y, 9M, 9C, 9K, and then the toner images are fixed to the continuous sheet by the fixing device 10, whereby a color image is formed on the rear surface of the continuous sheet.

Thereafter, the continuous sheet fed out from the rear-surface printing apparatus 4 is introduced into the buffer apparatus 5. While the buffer apparatus 5 applies an adequate tension to the continuous sheet, the continuous sheet is wound into a roll in the post-processing apparatus 6. As a result of the series of image forming operations, color images can be printed onto the both faces of the continuous sheet. When the image forming systems of the front- and rear-surface printing apparatus 2, 4 are changed from the color system to the monochrome system, monochrome images can be formed onto the both faces of the continuous sheet.

In the printing apparatus 100 which operates as described above, for example, the front-surface printing apparatus 2 and the sheet reversing apparatus 3 use various replaceable consumables. Specific examples of the consumables are toners, a toner recovery container, a developer (magnetic particles), a drum cleaner brush, a toner filter, a transfer cleaner, and a desmoke filter.

The toners are used while being accommodated in dedicated containers (for example, toner bottles) for respective colors of Y, M, C, and K. The toner recovery container recoveries a toner (waste toner) which has been removed from the surface of the photosensitive drum by a drum cleaning blade. The developer is mixed with the toner in the developing device, and used for charging the toner by frictional charging or the like. The drum cleaner brush removes unwanted toner remaining on the surface of the photosensitive drum. The toner filter is used for recovering the toner (waste toner) which has been removed away from the surface of the photosensitive drum by the drum cleaner brush, by air suction due to a blower or the like. The transfer cleaner removes contamination from the transferring device. The desmoke filter removes smoke which is produced by illuminating the continuous sheet with light of a flash lamp that is disposed as a heat source in the fixing device.

In the above, examples of consumables which are used by the front- and rear-surface printing apparatus 2, 4 in the printing apparatus 100 are shown. The management object may include consumables used by the other apparatuses (the sheet feeding apparatus 1, the sheet reversing apparatus 3, the buffer apparatus 5, and the post-processing apparatus 6). The consumables to be managed in the invention may include: consumables in which the consumption amount is increased by use in the image forming operations, such as toners, inks, sheets, and staples; those in which the acceptable capacity is decreased by use in the image forming operations, such as a toner recovery container and a punched scrap recovery container; those in which the characteristics are impaired by use in the image forming operations, such as filters, developers, cleaners, and photosensitive drums; and those which are worn by use in the image forming operations, such as rolls and belts.

Figure 2:
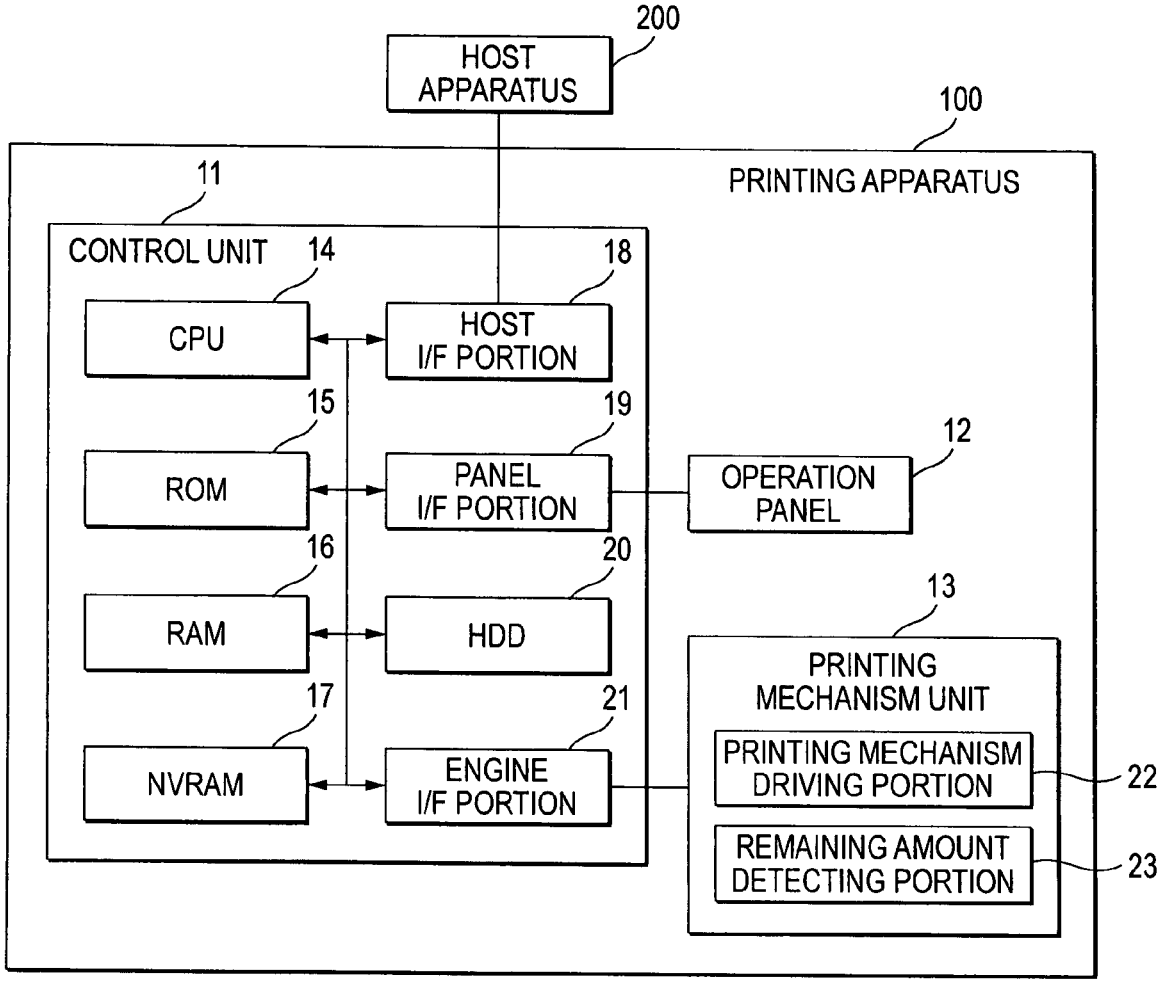
FIG. 2 is a block diagram showing the configuration of a control system of the printing apparatus which is an exemplary embodiment of the invention.

FIG. 2 is a block diagram showing a configuration example of a control system of the printing apparatus which is the exemplary embodiment of the invention. As illustrated, the printing apparatus 100 mainly includes a control unit 11, an operation panel 12, and a printing mechanism unit 13. The control unit 11 has a CPU (Central Processing Unit) 14, a ROM (Read-Only Memory) 15, a RAM (Random Access Memory) 16, a non-volatile memory (NVRAM) 17, a host interface portion ("I/F" in the figure is an abbreviation of "interface") 18, a panel interface portion 19, a hard disk drive (HDD) 20, and an engine interface portion 21.

The CPU 14 reads out and executes programs stored in, for example, the ROM 15 or the hard disk drive 20, to perform various control processes. The non-volatile memory 17 stores various control data which are to be used in the control processes of the CPU 14. The control data stored in the non-volatile memory 17 include information of thresholds (TH1, TH2) to be applied to a consumable management process which will be described later. The consumable management process is performed as one of the control processes of the CPU 14.

The host interface portion 18 is an interface for exchanging various information and data between the control unit 11 and a host apparatus 200. The host apparatus 200 is configured by, for example, a print server. Data to be sent from the host apparatus 200 to the control unit 11 include image data for printing. The panel interface portion 19 is an interface for exchanging various information and data between the control unit 11 and the operation panel 12. The engine interface portion 21 is an interface for exchanging various information and data between the control unit 11 and the printing mechanism unit 13.

The operation panel 12 is used for allowing the operator who operates the printing apparatus 100, to input various information, and displaying various information to the operator. The operation panel 12 is configured by, for example, an input portion having various buttons, switches, keys, and the like, and a display portion consisting of a liquid crystal display device with a touch panel.

The printing mechanism unit 13 includes a mechanical print engine for forming an image, a printing mechanism driving portion 22, and a remaining amount detecting portion 23. The printing mechanism driving portion 22 receives print instructions (including image data for printing) from the control unit 11 via the engine interface portion 21, and drives the print engine in accordance with the received print instructions, thereby causing the print engine to perform the above-described image forming operations. When the print process based on the print instructions from the control unit 11 is ended, the printing mechanism driving portion 22 notifies the control unit 11 of this.

The remaining amount detecting portion 23 detects, for each of the consumables used in the printing apparatus 100 to perform the image forming operations, the amount remaining before the life end. As an example, a case will be described where the amount of each consumable remaining before the life end is indicated by a relative ratio with respect to the case where the remaining amount of a new consumable is set to 100%, and the remaining amount detecting portion 23 detects the amount of each consumable remaining before the life end as a value in the range of 100% or less and 0% or more.

The printing mechanism driving portion 22 notifies the control unit 11 of various notifications on the basis of the detection result of the remaining amount detecting portion 23. When the amount of a consumable remaining before the life end detected by the remaining amount detecting portion 23 reaches a preset near life value (e.g., 10%), for example, the printing mechanism driving portion 22 notifies the control unit 11 that the consumable approaches the life end. When the amount of a consumable remaining before the life end detected by the remaining amount detecting portion 23 reaches 0% (life end determination value), the printing mechanism driving portion 22 notifies the control unit 11 that the consumable reaches the life end. At the same time, the driving portion determines that an error due to the life end of the consumable (hereinafter, referred to as "consumable error") occurs in the printing apparatus 100, and stops the operation (image forming operation) of the printing mechanism unit 13 using the printing engine.

As the method of detecting the remaining amount of a consumable by the remaining amount detecting portion 23, in the case of a consumable in which a physical amount to be detected in the remaining amount detection is consumed, for example, the following method may be employed. Namely, the remaining amount of a toner is detected by using a tower remaining amount detection sensor which detects the amount of the toner remaining in a toner bottle, and the amount remaining before the life end is calculated.

In the case of a consumable in which a physical amount to be detected in the remaining amount detection is not consumed, for example, the following method may be employed. Namely, the amount of a toner filter remaining before the life end, that of a drum cleaner brush remaining before the life end, and that of a developer remaining before the life end are detected by measuring a cumulative operation time from a replacement timing, and subtracting the measured value from a preset maximum operation time that is allowed until replacement of the consumable.

Alternatively, the following method may be employed. For example, the amount of a transfer cleaner remaining before the life end is detected by measuring the number of operations of the transferring device, and subtracting the measured value from a maximum operation number that is allowed until replacement of the transfer cleaner. The amount of a desmoke filter remaining before the life end is detected by measuring the number of operations of the flash lamp of the fixing device, and subtracting the measured value from a maximum operation number that is allowed until replacement of the desmoke filter.

Figure 3:
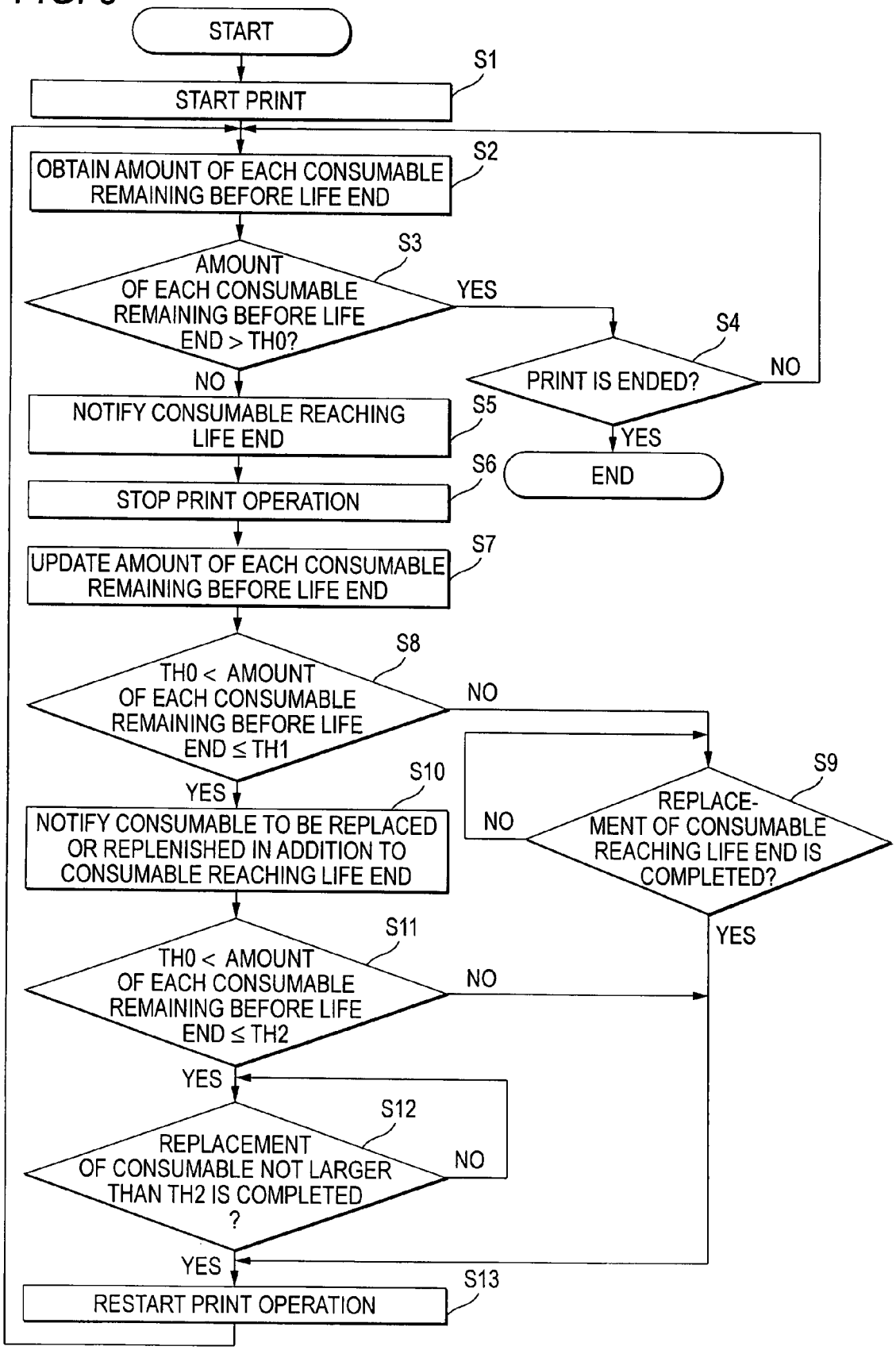
FIG. 3 is a flowchart showing an example of a consumable management process.

FIG. 3 is a flowchart showing an example of the consumable management process performed in the control unit 11. The consumable management process is realized by causing CPU 14 to read out programs stored in the ROM 15 or the hard disk drive 20 into the RAM 16 and execute the programs. Program for the process may be previously installed on the printing apparatus 100, or may be provided by storing the programs on a record medium which can be read by a computer, such as a CD-ROM, an MO, or a DVD. Alternatively, the programs may be provided via a wired or wireless communication network without using a record medium.

First, image data for printing which are sent from the host apparatus 200 to the own apparatus (printing apparatus 100) are introduced into the control unit 11 through the host interface portion 18. When the operator then performs an operation of starting the print process (for example, an operation of depressing a print start button) on the operation panel 12, the control unit 11 receives the instructions through the panel interface portion 19, and supplies print instructions to the printing mechanism unit 13 through the engine interface portion 21, thereby starting the print process in the printing mechanism unit 13 (step S1).

Next, the control unit 11 obtains the amount of each consumable remaining before the life end (step S2). In step S2, with respect to consumables in which the remaining amount detected by the remaining amount detecting portion 23 is not larger than the near life value, for example, the control unit 11 obtains information relating to the remaining amount of each of the consumables, from the printing mechanism driving portion 22. At this time, with respect to all consumables used in the plural apparatuses (the sheet feeding apparatus 1, the front-surface printing apparatus 2, the sheet reversing apparatus 3, the rear-surface printing apparatus 4, the buffer apparatus 5, and the post-processing apparatus 6) constituting the printing apparatus 100, information relating to the remaining amounts of the consumables in which the remaining amount before the life end is not larger than the near life value may be obtained. Alternatively, with respect to consumables used in the front-surface printing apparatus 2 and the rear-surface printing apparatus 4 among the plural apparatuses, information relating to the remaining amounts of the consumables in which the remaining amount before the life end is not larger than the near life value may be obtained.

In the printing apparatus 100, in the case where the remaining amount of the black toner of the front-surface printing apparatus 2, that of the black toner filter of the front-surface printing apparatus 2, that of the magenta toner of the rear-surface printing apparatus 4, and that of the desmoke filter of the rear-surface printing apparatus 4 are not larger than the respective near life values, for example, the control unit 11 obtains information relating to the remaining amounts of the four consumables, from the printing mechanism driving portion 22. For example, information relating to the remaining amounts of consumables is obtained for each of the consumables in the form where consumable identification information which uniquely identifies the consumable corresponds in a one-to-one relationship to the remaining amount of the consumable identified by the consumable identification information. In the description, it is assumed that, with respect to consumables in which the remaining amount detected by the remaining amount detecting portion 23 is not larger than the near life value, information relating to the remaining amounts of the consumables is obtained. Alternatively, in addition to consumables in which the remaining amount is not larger than the near life value, information relating to the remaining amounts of consumables in which the remaining amount exceeds the near life value may be obtained.

Next, the control unit 11 determines whether the amount of each consumable remaining before the life end is larger than a first threshold TH0 or not (step S3). If there is no consumable in which the amount remaining before the life end is not larger than the first threshold TH0, the control transfers to step S4.

In step S4, the control unit 11 determines whether the print process based on the print instructions is ended in the printing mechanism unit 13 or not, based on whether there is a print end notification from the printing mechanism driving portion 22 or not. If there is the print end notification from the printing mechanism driving portion 22, the consumable management process is ended at this state. If there is not the print end notification from the printing mechanism driving portion 22, the control returns to step S2.

By contrast, if it is determined in step S3 that there is a consumable in which the amount remaining before the life end is not larger than the first threshold TH0, the control unit 11 determines that there is a consumable reaching the life end, and notifies the operator of this (step S5).

Next, in accordance with the occurrence of the consumable error, the control unit 11 stops the operation of the printing mechanism unit 13 due to the print engine (step S6).

Next, the control unit 11 updates the amount of each consumable remaining before the life end (step S7).

Then, the control unit 11 determines whether, with respect to the other consumables excluding the consumables in which the amount remaining before the life end is determined in step S3 not to be larger than the first threshold TH0, the amount of each consumable remaining before the life end is larger than the first threshold TH0, and not larger than a second threshold TH1 (step S8). The process of step S8 is a process of determining whether, in addition to replacement or replenishment of consumables reaching the life end, a consumable to be replaced or replenished exists or not. The process of step S7 is a process of, when the print operation in the printing mechanism unit 13 is actually stopped, updating the amount of each consumable remaining before the life end, thereby allowing the determination process of step S8 to be performed more correctly.

If it is determined in step S8 that, in addition to replacement or replenishment of consumables reaching the life end, a consumable to be replaced or replenished does not exist (if No is determined), the control unit 11 determines whether replacement or replenishment of consumables reaching the life end is completed or not (step S9). If replacement or replenishment is completed, the control transfers to step S13.

In step S13, the control unit 11 again issues the print instructions to the printing mechanism unit 13 in which the operation has been stopped by the occurrence of the consumable error, to cause the print operation to be restarted, and the control then returns to step S2. The restart of the print operation in step S13 may be performed in the following manner. When the operation is stopped by the occurrence of the consumable error, image data subsequent to the page where printing on the continuous sheet is in a half-finished state are supplied to the printing mechanism unit 13, thereby restarting the print operation. Alternatively, the print operation may be restarted by supplying image data of all pages in which the print operation is stopped halfway, or by supplying new image data to the printing mechanism unit 13.

By contrast, if it is determined in step S8 that, in addition to replacement or replenishment of consumables reaching the life end, a consumable to be replaced or replenished exists (if Yes is determined), the control unit 11 performs a notification process of prompting the operator to, in addition to consumables reaching the life end, replace or replenish the consumable to be replaced or replenished (step S10).

Then, the control unit 11 determines whether, with respect to the other consumables excluding the consumables in which the amount remaining before the life end is determined in step S3 not to be larger than the first threshold TH0, the amount of each consumable remaining before the life end is larger than the first threshold TH0, and not larger than a third threshold TH2 (step S11). If there is a consumable in which the amount remaining before the life end is larger than the first threshold TH0 and not larger than the third threshold TH2, the control proceeds to step S12 in order to inhibit the restart of the print operation until replacement or replenishment of the consumable which is to be additionally replaced or replenished is completed. Instep S12, the control unit 11 determines whether replacement of the consumable in which the amount remaining before the life end is larger than the first threshold TH0 and not larger than the third threshold TH2 is completed or not. If the replacement is completed, the control proceeds to step S13 to restart the print operation.

If it is determined in step S11 that a consumable in which the amount remaining before the life end is larger than the first threshold TH0, and not larger than the third threshold TH2 does not exist, the control unit 11 transfers from step S11 to step S13 in order to allow the restart of the print operation to be performed even when replacement or replenishment of the consumable which is to be additionally replaced or replenished has not yet been completed.

Figure 4:
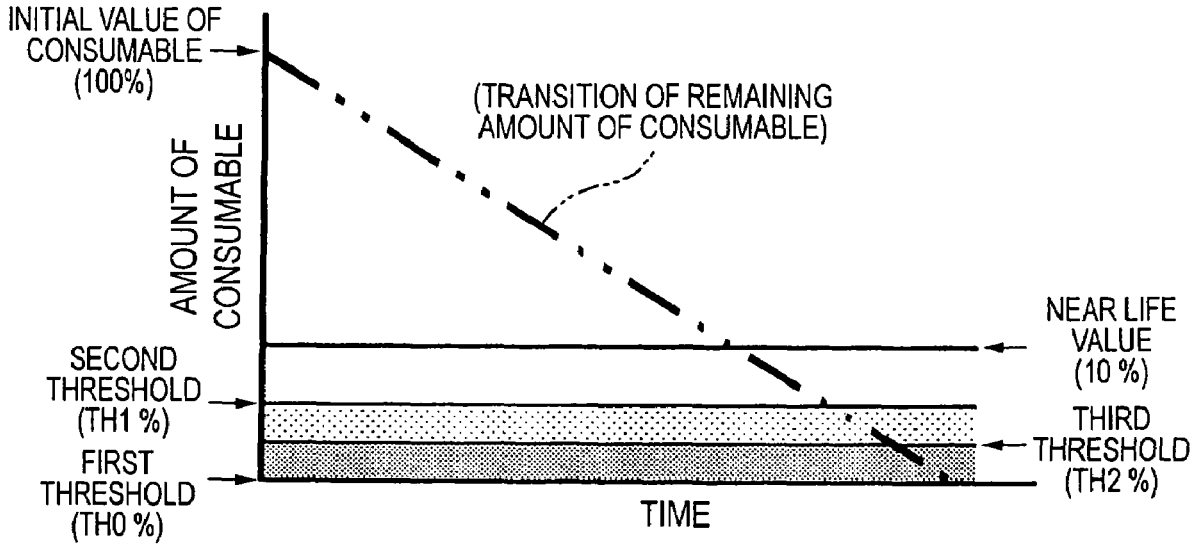
FIG. 4 is a conceptual diagram of threshold setting.

The settings of the first threshold TH0, the second threshold TH1, and the third threshold TH2 will be described with reference to FIG. 4. The thresholds TH0, TH1, TH2 are previously set in the control unit 11, and, in accordance with the settings, stored into the non-volatile memory 17. The first threshold TH0 is a threshold for, in the case where the initial value (maximum value) of the remaining amount of a consumable before the life end is set to 100%, determining whether the consumable reaches the life end or not. For example, the first threshold is set to 0% or a value similar to it. The second threshold TH1 is set to a value which is smaller than the near life value (in the illustrated example, 10%), and which is larger than the first threshold TH0. The third threshold TH2 is set to a value which is smaller than the second threshold TH1, and which is larger than the first threshold TH0.

FIGS. 5 and 6 are views showing examples of a screen which is displayed on the operation panel 12 in accordance with display control instructions from the control unit 11 in the notification process of prompting replacement of a consumable.

In a screen A shown in FIG. 5A, a message of instructing a work of replacing a consumable (in the illustrated example, a black toner) which is determined to reach the life end (in the illustrated example, toner empty) as a result of a consumable error, and a start button 24 which causes the control unit 11 to recognize the start of replacement of the consumable are displayed. When the operator depresses the start button 24 in a state where the screen A is displayed on the operation panel 12, the display screen of the operation panel 12 is switched to a screen B shown in FIG. 5B in accordance with display switch instructions from the control unit 11.

In the screen B shown in FIG. 5B, a message of instructing a work of replacing a consumable (replacement procedure), and an end button 25 which causes the control unit 11 to recognize the end of replacement of the consumable are displayed. When the operator depresses the end button 25 in a state where the screen B is displayed on the operation panel 12, the display screen of the operation panel 12 is switched to a normal screen (not shown) in accordance with display switch instructions from the control unit 11, in the case where there is no consumable which is recommended to be replaced (consumable in which the amount remaining before the life end is not larger than the second threshold TH1), or the case where replacement of all consumables which are recommended to be replaced is ended. The normal screen is a screen for receiving instructions for starting the print operation from the operator, informing the operator of the progress of the print operation, and transferring to various setting screens.

Each time when the operator replaces a consumable in accordance with the screen B and depresses the end button 25 (each time when one consumable is replaced), the control unit 11 sends to the printing mechanism unit 13 a notification that replacement of the consumable is completed. In response to the replacement completion notification, the printing mechanism driving portion 22 returns the remaining amount of the consumable to which the replacement completion notification is issued, to the initial value (100%). In the case where the consumable for which the replacement completion notification is received from the control unit 11 is a consumable that is determined to reach the life end as a result of a consumable error, the printing mechanism driving portion 22 cancels the consumable error state, and returns the printing mechanism unit 13 to the normal state.

In the case where a consumable which is recommended to be replaced (consumable in which the amount remaining before the life end is not larger than the second threshold TH1) exists when the operator depresses the end button 25 in a state where the screen B is displayed on the operation panel 12, the display screen of the operation panel 12 is switched to a screen C shown in FIG. 6A in accordance with display switch instructions from the control unit 11.

In the screen C shown in FIG. 6A, a message of recommending replacement of consumables, and the names and remaining amounts of the consumables which are recommended to be replaced are displayed. When the consumables which are recommended to be replaced include a consumable in which the amount remaining before the life end is not larger than the third threshold TH2, the screen C is displayed in a state where the consumable is selected by default as the replacement object, and a start button 26 which causes the control unit 11 to recognize the start of replacement of the consumable is displayed. In the illustrated example, assuming that the second threshold TH1 is set to 5% and the third threshold TH2 is set to 3%, the screen C is displayed in a state where a black developer in which the remaining amount is 2% is selected by default as the replacement object.

In this case, in addition to the names and remaining amounts of the consumables which are recommended to be replaced, the number of pages which can be printed with using the remaining amount of each of the consumables may be displayed. Candidates which are selectable as the replacement object may be limited only to consumables in which the amount remaining before the life end is not larger than the third threshold TH2. In order to, in the screen C, easily distinguish between a consumable in which the amount remaining before the life end is not larger than the second threshold TH1 and exceeds the third threshold TH2, and that in which the amount remaining before the life end is not larger than the third threshold TH2, for example, the display is performed while changing the formats of displayed characters (the color, the size, the thickness, and the like), or a warning symbol (!) may be displayed beside characters indicative of a consumable in which the amount remaining before the life end is not larger than the third threshold TH2. Alternatively, only a consumable in which the amount remaining before the life end is not larger than the third threshold TH2 is displayed in the screen C, and, after replacement of the consumable is completed, a screen (screen D) for prompting replacement of a consumable in which the amount remaining before the life end is not larger than the second threshold TH1 and exceeds the third threshold TH2 may be displayed. When the screen A is displayed, consumables which are recommended to be replaced may be listed in the screen A.

When the operator depresses the start button 26 in the screen C, in a similar manner as the screen B, the display screen of the operation panel 12 is switched in accordance with display switch instructions from the control unit 11, to a screen including: a message of instructing a work of replacing a consumable (replacement procedure); and the end button 25 which causes the control unit 11 to recognize the end of replacement of the consumable. When the operator depresses the end button 25 after the consumable is replaced, the display screen of the operation panel 12 is switched to the screen D shown in FIG. 6B, in accordance with display switch instructions from the control unit 11.

In the screen D shown in FIG. 6B, a message of recommending replacement of consumables excluding the consumable in which replacement has been completed, and the names and remaining amounts of the consumables which are recommended to be replaced are again displayed. In the case where there are plural candidates which are selectable as the replacement object, the screen D may be displayed in a state where the consumable of the least remaining amount is selected by default as the replacement object. In the screen D, the start button 26 which causes the control unit 11 to recognize the start of replacement of the consumable, and a close button 27 which causes the control unit 11 to recognize cancellation of replacement of a consumable are displayed. When the operator depresses the start button 26, in a similar manner as the screen B, the display screen of the operation panel 12 is switched in accordance with display switch instructions from the control unit 11, to a screen including: a message of instructing a work of replacing a consumable (replacement procedure); and the end button 25 which causes the control unit 11 to recognize the end of replacement of the consumable. When the operator depresses the close button 27, the display screen on the operation panel 12 is switched to the normal screen (not shown) in accordance with display switch instructions from the control unit 11.

By contrast, in the case where a consumable in which the amount remaining before the life end is not larger than the third threshold TH2 is not included in the consumables which are recommended to be replaced, when the operator depresses the end button 25 in the screen B, in a similar manner as the screen D, the display screen of the operation panel 12 is switched in accordance with display switch instructions from the control unit 11, to a screen including, in a state where one of the consumables is selected as a replacement object: the start button 26 which causes the control unit 11 to recognize the start of replacement of the consumable; and the close button 27 which causes the control unit 11 to recognize cancellation of replacement of a consumable. When the operator depresses the start button 26, in a similar manner as the screen B, the display screen of the operation panel 12 is switched in accordance with display switch instructions from the control unit 11, to a screen including: a message of instructing a work of replacing a consumable (replacement procedure); and the end button 25 which causes the control unit 11 to recognize the end of replacement of the consumable. When the operator depresses the close button 27, the display screen of the operation panel 12 is switched to the normal screen (not shown) in accordance with display switch instructions from the control unit 11.

The notification process which is performed in step S5 prompts the operator to replace or replenish a consumable that is determined to reach the life end as a result of a consumable error. Therefore, the control unit 11 sequentially switches the display screen of the operation panel 12 in the format of the screen A and the screen B, and thereafter returns the display screen to the normal screen.

The notification process which is performed in step S10 prompts the operator to replace (or replenish) a consumable which is to be replaced or replenished, in addition to replacement (or replenishment) of a consumable that is determined to reach the life end as a result of a consumable error. Therefore, the control unit 11 sequentially switches the display screen of the operation panel 12 in the format of the screen A and the screen B, and thereafter displays the display screen in the format of the screen C or the screen D, thereby prompting replacement of a consumable in which the amount remaining before the life end is not larger than the second threshold TH1. In this case, the close button 27 for canceling replacement of a consumable is displaced in the screen D. When the operator depresses the close button 27 in the screen D, therefore, the print operation is restarted in the printing mechanism unit 13 even when replacement of a consumable which is recommended to be replaced in the screen is not performed.

By contrast, in order to inhibit the restart of the operation of the printing mechanism unit 13 of the printing apparatus 100 until replacement of the consumable (in the illustrated example, the black developer) in which the amount remaining before the life end is not larger than the third threshold TH2 is completed, the close button 27 for canceling replacement of a consumable is not displaced in the screen C. In order to allow the restart of the operation of the printing mechanism unit 13 of the printing apparatus 100 after replacement of the consumable in which the amount remaining before the life end is not larger than the third threshold TH2 is completed, the display screen of the operation panel 12 is switched to the format of the screen D after the end of replacement of the consumable (a consumable in which the amount remaining before the life end is not larger than the third threshold TH2) which is selected as the replacement object in the screen C is recognized by depression of the end button 25.

Furthermore, the control unit 11 includes a unit that sets (changes) the thresholds TH1, TH2 which are referred in steps S8, S11 described above, according to the operation of the operator. More specifically describing the unit, in the state where the normal screen is displayed on the operation panel 12, when the operator selects a threshold setting tab or the like in the normal screen, the control unit 11 switches the display screen of the operation panel 12 from the normal screen to a threshold setting screen. The information of the thresholds (TH1, TH2) is initially stored into the non-volatile memory 17 by default setting.

FIGS. 7A and 7B show a display example of the threshold setting screen. In threshold setting screen 1 shown in FIG. 7A, the types of consumables in which a threshold change can be set are displayed. Then, the operator selects one type (in the illustrated example, the developer) of the consumable in which the setting of the threshold is desired to be changed, and depresses a select button 28 in the screen. In accordance with display switch instructions from the control unit 11, then, the display screen of the operation panel 12 is switched to threshold setting screen 2 shown in FIG. 7B. In the threshold setting screen 2, the operator adequately selects a threshold (TH1, TH2) in which the setting is desired to be changed, and an operation type of the printing apparatus 100, inputs a desired value (threshold), and then depresses a confirmation button 29 in the screen, whereby the CPU 14 is caused to rewrite the threshold in the non-volatile memory 17 in accordance with the value designated by the operator. As a result, in the control unit 11, the setting (change) of the threshold is performed for each consumable type.

In the threshold setting screen 2, the second threshold TH1 and the third threshold TH2 can be independently set in accordance with the above-described threshold setting conditions (near life value>TH1>TH2>TH0). In the threshold setting screen 2, the thresholds TH1, TH2 can be set for each of the operation types (in the illustrated example, a single printing operation type and a tandem printing operation type) of the printing apparatus 100. In the illustrated example, a scene where the second threshold TH1 applied to the developer in the single printing operation type is set by inputting a numerical value is shown. In the tandem printing operation type, the front-surface printing apparatus 2 and the sheet reversing apparatus 3 are coupled to each other, and images are printed onto the both faces of a continuous sheet. In the single printing operation type, the front-surface printing apparatus 2 and the sheet reversing apparatus 3 operate independently so that the front-surface printing apparatus 2 prints an image on one face of a continuous sheet, and the sheet reversing apparatus 3 prints an image on one face of another continuous sheet.

In the case where consumables dedicated to respective colors of Y, M, C, and K exist even in consumables of the same type, the setting of the thresholds may be performed in the following manner so that a threshold can be set for each consumable. As shown in FIG. 8, for example, the operator selects one or plural color toners by a select button 30 from four toners corresponding to Y, M, C, and K. Thereafter, the screen is switched to the display of the threshold setting screen 2, and designation of the threshold (input of a numerical value) by the operator is accepted, whereby a threshold can be set for each consumable. This is similarly applicable also to the other consumables such as the toner filter, the developer, the drum cleaner brush, and the transfer cleaner.

In the exemplary embodiment, as a notification process of prompting the operator to replace a consumable, the display process in which the operation panel 12 having a display function is used has been described as an example. The invention is not restricted to this. For example, replacement of a consumable may be prompted by an audio output process using a speaker and the like, or a character print process using a small printer and the like.

In the exemplary embodiment, the countermeasure against the case where the operation (image forming operation) of the printing apparatus 100 is stopped by occurrence of a consumable error has been described. The invention is not restricted to this, and may be similarly applied to a countermeasure against the case where the operation of the printing apparatus 100 is stopped by occurrence of an error other than a consumable error, such as sheet jamming, running out of sheet, lack of image data, apparatus malfunction, or failure.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A consumable management device comprising:

a life determining unit that determines whether or not a consumable reaching a life end exists in an object apparatus which operates by using a plurality of consumables;

an acquiring unit that acquires an amount of each of the plurality of consumables remaining before the life end, wherein the life determining unit determines that, when, for at least one of the consumables, the amount of the consumable remaining before the life end acquired by the acquiring unit is not larger than a first threshold, the consumable reaching the life end exists;

a stop process unit that, when the life determining unit determines that the consumable reaching the life end exists, performs a stop process of stopping the operation of the object apparatus;

an additional replacement determining unit that, when the object apparatus is to be stopped, determines whether or not, in addition to replacement or replenishment of the consumable reaching the life end, a consumable which is to be additionally replaced or replenished exists, wherein the additional replacement determining unit determines that, when, for at least one of the remaining consumables, the amount of the consumable remaining before the life end acquired by the acquiring unit is larger than the first threshold and not larger than a second threshold, which is larger than the first threshold, the consumable which is to be additionally replaced or replenished, in addition to the consumable reaching the life end, exists;

a notification process unit that, when the additional replacement determining unit determines that the consumable which is to be additionally replaced or replenished exists, performs a notification process of notifying an operator that the consumable which is to be additionally replaced or replenished is to be replaced or replenished;

an inhibiting unit that, in a case where the amount remaining before the life end of the consumable which is to be additionally replaced or replenished is larger than the first threshold and not larger than a third threshold, which is smaller than the second threshold, inhibits a restart of the operation of the object apparatus until replacement or replenishment of the consumable which is to be additionally replaced or replenished is completed; and an allowing unit that, in a case where the amount remaining before the life end of the consumable which is to be additionally replaced or replenished is larger than the third threshold, allows a restart of the operation of the object apparatus even when replacement or replenishment of the consumable which is to be additionally replaced or replenished is not completed.

2. The consumable management device according to claim 1, wherein the acquiring unit detects a cumulative operation time of the consumable, and a maximum cumulative operation time that is allowed until replacement of the consumable, and acquires the amount of the consumable remaining before the life end, based on the detected cumulative operation time of the consumable, and the maximum cumulative operation time that is allowed until replacement of the consumable.

3. The consumable management device according to claim 1, wherein, after the operation of the object apparatus is stopped by the stop process unit, the additional replacement determining unit determines whether the consumable which is to be additionally replaced or replenished exists or not.

4. The consumable management device according to claim 1, wherein, in a case where the object apparatus includes a plurality of apparatuses which are connected to one another, the notification process unit performs a notification process of, for consumables used in the plurality of apparatuses, prompting the operator to replace or replenish the consumable which is to be additionally replaced or replenished.

5. The consumable management device according to claim 1, wherein the device further comprises a threshold setting unit that is capable of setting the second threshold for each of consumables, kinds of consumables, or operation types of object apparatuses.

6. The consumable management device according to claim 1, wherein the consumable is attached to the object apparatus while enabling the consumable to be replaced and replenished in a state where the operation of the object apparatus is stopped.

7. An image forming apparatus comprising:

an image forming mechanism portion that operates by using a plurality of consumables;

a life determining unit that determines whether or not a consumable reaching a life end exists in an object apparatus which operates by using the plurality of consumables;

an acquiring unit that acquires an amount of each of the plurality of consumables remaining before the life end, wherein the life determining unit determines that, when, for at least one of the consumables, the amount of the consumable remaining before the life end acquired by the acquiring unit is not larger than a first threshold, the consumable reaching the life end exists;

a stop process unit that, when the life determining unit determines that the consumable reaching the life end exists, performs a stop process of stopping the operation of the object apparatus;

an additional replacement determining unit that, when the object apparatus is to be stopped, determines whether or not, in addition to replacement or replenishment of the consumable reaching the life end, a consumable which is to be additionally replaced or replenished exists, wherein the additional replacement determining unit determines that, when, for at least one of the remaining consumables, the amount of the consumable remaining before the life end acquired by the acquiring unit is larger than the first threshold and not larger than a second threshold, which is larger than the first threshold, the consumable which is to be additionally replaced or replenished, in addition to the consumable reaching the life end, exists;

a notification process unit that, when the additional replacement determining unit determines that the consumable which is to be additionally replaced or replenished exists, performs a notification process of notifying an operator that the consumable which is to be additionally replaced or replenished is to be replaced or replenished;

an inhibiting unit that, in a case where the amount remaining before the life end of the consumable which is to be additionally replaced or replenished is larger than the first threshold and not larger than a third threshold, which is smaller than the second threshold, inhibits a restart of the operation of the object apparatus until replacement or replenishment of the consumable which is to be additionally replaced or replenished is completed; and an allowing unit that, in a case where the amount remaining before the life end of the consumable which is to be additionally replaced or replenished is larger than the third threshold, allows a restart of the operation of the object apparatus even when replacement or replenishment of the consumable which is to be additionally replaced or replenished is not completed.

8. A computer readable medium storing a program causing a computer to execute a process for managing consumables, the process comprising:

determining whether or not a consumable reaching a life end exists in an object apparatus which operates by using a plurality of consumables;

acquiring an amount of each of the plurality of consumables remaining before the life end;

determining that, when, for at least one of the consumables, the amount of the consumable remaining before the life end is not larger than a first threshold, the consumable reaching the life end exists;

stopping the operation of the object apparatus, when it is determined that the consumable reaching the life end exists;

determining whether or not, in addition to replacement or replenishment of the consumable reaching the life end, a consumable which is to be replaced or replenished exists, when the object apparatus is to be stopped;

determining that, when, for at least one of the remaining consumables, the amount of the consumable remaining before the life end is larger than the first threshold and not larger than a second threshold, which is larger than the first threshold, the consumable which is to be additionally replaced or replenished, in addition to the consumable reaching the life end, exists;

notifying an operator that the consumable which is to be additionally replaced or replenished is to be replaced or replenished, when it is determined that the consumable which is to be additionally replaced or replenished exists;

inhibiting a restart of the operation of the object apparatus in a case where the amount remaining before the life end of the consumable which is to be additionally replaced or replenished is larger than the first threshold and not larger than a third threshold, which is smaller than the second threshold, until replacement or replenishment of the consumable which is to be additionally replaced or replenished is completed; and allowing a restart of the operation of the object apparatus, in a case where the amount remaining before the life end of the consumable which is to be additionally replaced or replenished is larger than the third threshold, even when replacement or replenishment of the consumable which is to be additionally replaced or replenished is not completed.

9. A consumable management method comprising:

determining whether or not a consumable reaching a life end exists in an object apparatus which operates by using a plurality of consumables;

acquiring an amount of each of the plurality of consumables remaining before the life end, determining that, when, for at least one of the consumables, the amount of the consumable remaining before the life end is not larger than a first threshold, the consumable reaching the life end exists;

performing a stop process of stopping the operation of the object apparatus when the consumable reaching the life end exists;

determining whether or not, in addition to replacement or replenishment of the consumable reaching the life end, a consumable which is to be additionally replaced or replenished exists, when the object apparatus is to be stopped;

determining that, when, for at least one of the remaining consumables, the amount of the consumable remaining before the life end is larger than the first threshold and not larger than a second threshold, which is larger than the first threshold, the consumable which is to be additionally replaced or replenished, in addition to the consumable reaching the life end, exists;

performing a notification process of notifying an operator that the consumable which is to be additionally replaced or replenished is to be replaced or replenished when the consumable which is to be additionally replaced or replenished exists;

inhibiting a restart of the operation of the object apparatus in a case where the amount remaining before the life end of the consumable which is to be additionally replaced or replenished is larger than the first threshold and not larger than a third threshold, which is smaller than the second threshold, until replacement or replenishment of the consumable which is to be additionally replaced or replenished is completed; and allowing a restart of the operation of the object apparatus, in a case where the amount remaining before the life end of the consumable which is to be additionally replaced or replenished is larger than the third threshold, even when replacement or replenishment of the consumable which is to be additionally replaced or replenished is not completed.

* * * * *